US007174834B2

(12) United States Patent
Dion et al.

(10) Patent No.: US 7,174,834 B2
(45) Date of Patent: Feb. 13, 2007

(54) EXPLOSIVE SHELL HAVING IMPROVED RESISTANCE TO SHOCKS

(75) Inventors: Dominique Dion, Bourges (FR); Sylvain Jayet, Bourges (FR); Règis Aumasson, Bourges (FR)

(73) Assignee: GIAT Industries, Versailles (FR)

( * ) Notice: Subject to any disclaimer, the term of this patent is extended or adjusted under 35 U.S.C. 154(b) by 160 days.

(21) Appl. No.: 10/975,508

(22) Filed: Oct. 29, 2004

(65) Prior Publication Data

US 2005/0155512 A1 Jul. 21, 2005

(30) Foreign Application Priority Data

Nov. 17, 2003 (FR) ..... 03 13523

(51) Int. Cl.
*F42B 39/14* (2006.01)
*F42B 39/20* (2006.01)

(52) U.S. Cl. ..... 102/481; 102/476; 102/473; 102/306

(58) Field of Classification Search ..... 102/473, 102/481, 342, 357, 422, 423, 428, 429, 216, 102/489, 499, 500; 86/20.14
See application file for complete search history.

(56) References Cited

U.S. PATENT DOCUMENTS 3,599,570 A * 8/1971 Ingersoll et al. ..... 102/499
3,978,795 A * 9/1976 Strunk et al. ..... 102/476
4,365,556 A 12/1982 Reibel
4,760,795 A 8/1988 Young
4,798,145 A * 1/1989 McVeagh ..... 102/476
4,945,834 A 8/1990 Young
5,133,259 A * 7/1992 Schluckebier ..... 102/364
5,210,372 A * 5/1993 Tripptrap et al. ..... 102/489
5,233,127 A * 8/1993 Sauvestre et al. ..... 102/489
5,239,929 A * 8/1993 Nilsson et al. ..... 102/473
5,351,622 A * 10/1994 Ekholm ..... 102/476
5,656,792 A * 8/1997 Rentzsch et al. ..... 102/489
6,860,185 B2 * 3/2005 Altenau ..... 86/51
7,025,000 B1 * 4/2006 Wong et al. ..... 102/481

FOREIGN PATENT DOCUMENTS

DE 39 29 020 A1 3/1991
EP 1338 860 A2 8/2003

* cited by examiner

*Primary Examiner*—James S. Bergin
(74) *Attorney, Agent, or Firm*—Oliff & Berridge, PLC

(57) ABSTRACT

An explosive shell comprising a fusible explosive load placed in a casing incorporating an opening, such shell comprising shimming means placed in the vicinity of the shell opening, such shimming means comprising a ring made of an elastic material placed between a front part of the shell casing and the explosive load, such ring being compressed by compression means, shell wherein the shimming ring incorporates a flange housed in a groove made in the casing of the shell.

6 Claims, 3 Drawing Sheets

EXPLOSIVE SHELL HAVING IMPROVED RESISTANCE TO SHOCKS

BACKGROUND OF THE INVENTION

1. Field of Invention

The technical scope of the invention is that of explosive shells.

2. Description of Related Art

Explosive shells generally comprise a cast explosive load placed in a metallic casing.

The casing incorporates an opening allowing the cast loading of the explosive. This opening is moreover intended to receive a fuse enabling the load to be ignited.

Shells must be able to be implemented over a wide range of temperatures (between −46° C. and +63° C.). These substantial variations lead to non-negligible dilations of the explosive which can attain several millimeters (2 to 5 mm). Furthermore, the shells are subjected to harsh mechanical environments (falls and vibrations).

The combination of thermal and mechanical shocks leads to the appearance of cracks in the explosive load. These cracks may lead to its inadvertent ignition when the shell is being used.

A shell comprising a composite explosive is known by patent EP1338860. So as to overcome the problems linked to the dilation of the explosive load, this shell comprise a bag-shaped case made of an elastic material, such case being placed between the shell casing and the load. Additionally, a retention washer is applied to one surface of the explosive load by screwing a fastening ring of the fuse.

With such a shell, the shell must be loaded with the composition, it must be polymerized by baking, and then an upper face of the load must be machined before positioning the retention washer.

SUMMARY OF THE INVENTION

The aim of the invention is to propose an explosive shell whose loading mode is simplified but which nevertheless has means to prevent the appearance of cracking, damage or looseness of the explosive load.

Thus, the invention relates to an explosive shell comprising a fusible explosive load placed in a casing incorporating an opening, such shell comprising shimming means placed in the vicinity of the shell opening, such shimming means comprising a ring made of an elastic material placed between a front part of the shell casing and the explosive load, such ring being compressed by compression means, shell wherein the shimming ring incorporates a flange housed in a groove made in the shell casing.

According to one embodiment, the compression means comprise a linking part screwed in the shell opening and exerting a compressive stress on the shimming ring.

The compression means will advantageously comprise a washer placed between the linking part and the shimming ring.

The shimming ring may have a cylindrical axial bore as well as an external profile matching the internal profile of the casing.

According to another embodiment of the invention, the shell may comprise a tablet of primer placed in the cylindrical axial bore in the shimming ring.

The shimming ring will be made of an elastomer material.

BRIEF DESCRIPTION OF THE DRAWINGS

Other advantages of the invention will become apparent from the following description of the embodiments, such description made in reference to the appended drawings, in which.

DETAILED DESCRIPTION OF PREFERRED EMBODIMENTS

Figure 1:
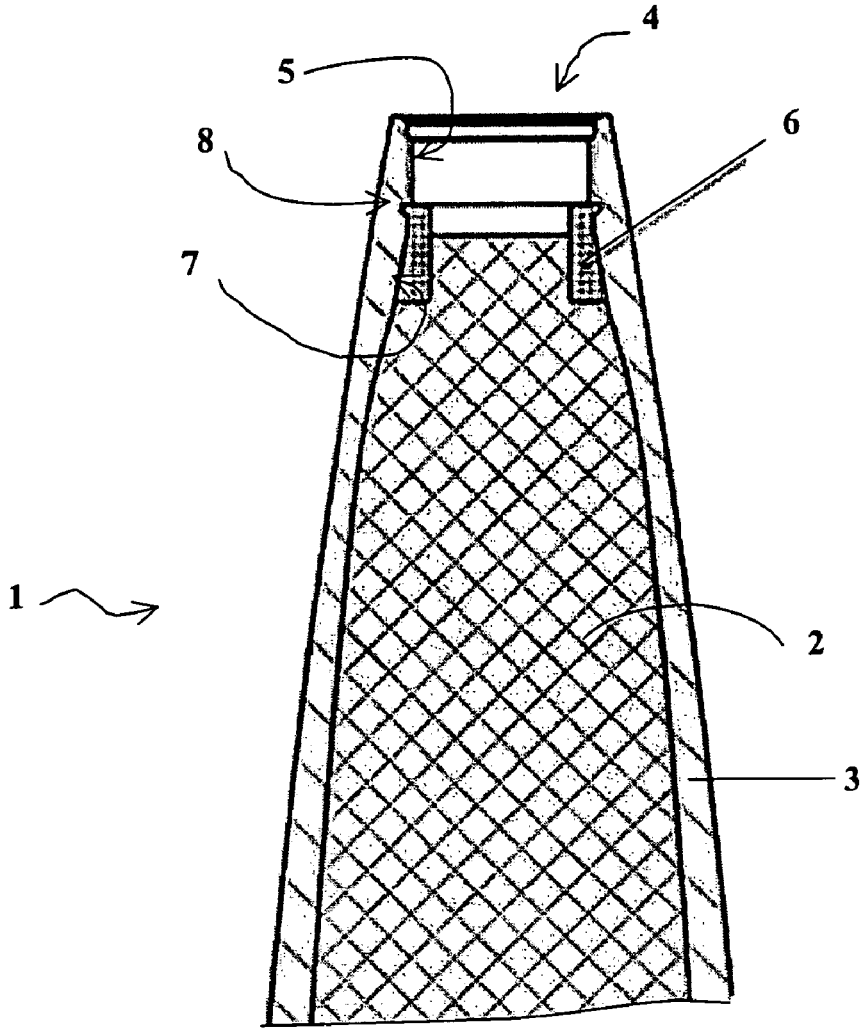
FIG. 1 shows a partial longitudinal section of a front part of a shell according to the invention after the explosive has been cast and before the linking part has been put in place.

With reference to FIG. 1, an explosive shell 1 according to the invention comprises a fusible explosive load 2 cast inside a metallic casing 3. The load may incorporate trinitrotoluene associated with wax and an additional explosive such as cyclonite or homocyclonite. It may also incorporate a relatively insensitive explosive such as oxynitrotriazol (ONTA).

To enabling the cast loading, the casing 3 incorporates an opening 4 that has female threading 5 allowing a primer fuse (not shown) to be fastened in it at a later time.

In accordance with the invention, this shell comprises shimming means for the explosive load 2 placed in the vicinity of the opening 4 in the shell.

These shimming means comprise a ring 6 made of an elastic material and placed between a front part 7 of the shell casing 3 and the explosive load 2.

This shimming ring is made of an elastomer material that is chemically compatible with the explosive 2 and has good ageing stability. The ring made, for example, be made of silicon rubber having 45 Shore hardness.

Figure 2:
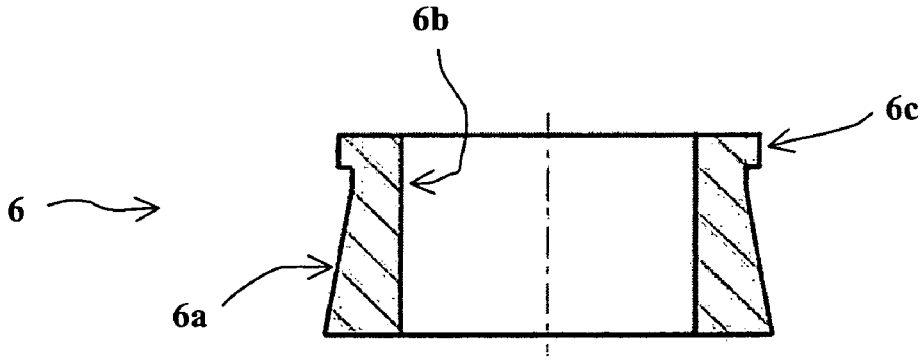
FIG. 2 is a view of a shimming ring alone.

FIG. 2 shows the ring 6 alone. It has a conical external profile 6*a* intended to match the internal profile 7 of the casing 3. It also incorporates a cylindrical axial bore 6*b* enabling the shell 1 to be cast load after the ring 6 is set into place.

The shimming ring 6 lastly incorporates a cylindrical external flange 6*c* intended to fit into a groove 8 in the casing 3 of the shell 1.

The material flexibility of the ring 6 enables it to be manually inserted, by elastic deformation, into the opening 4 in the shell 1 and before the load 2 is cast.

The flange 6*c* is introduced into the groove 8 and ensures the ring 6 is retained in place with respect to the shell 1 before the load 2 is cast.

Once in place, the external conical profile 6*a* of the ring 6 is in contact with the internal wall of the casing 3.

The explosive is then cast through the axial bore 6*b* in the ring.

The explosive load is cast until it reaches up inside the axial bore 6*b*.

Thus, at the front part of the shell 1, the ring 6 is placed between the explosive 2 and the internal wall 7 of the casing 3.

Figure 3:
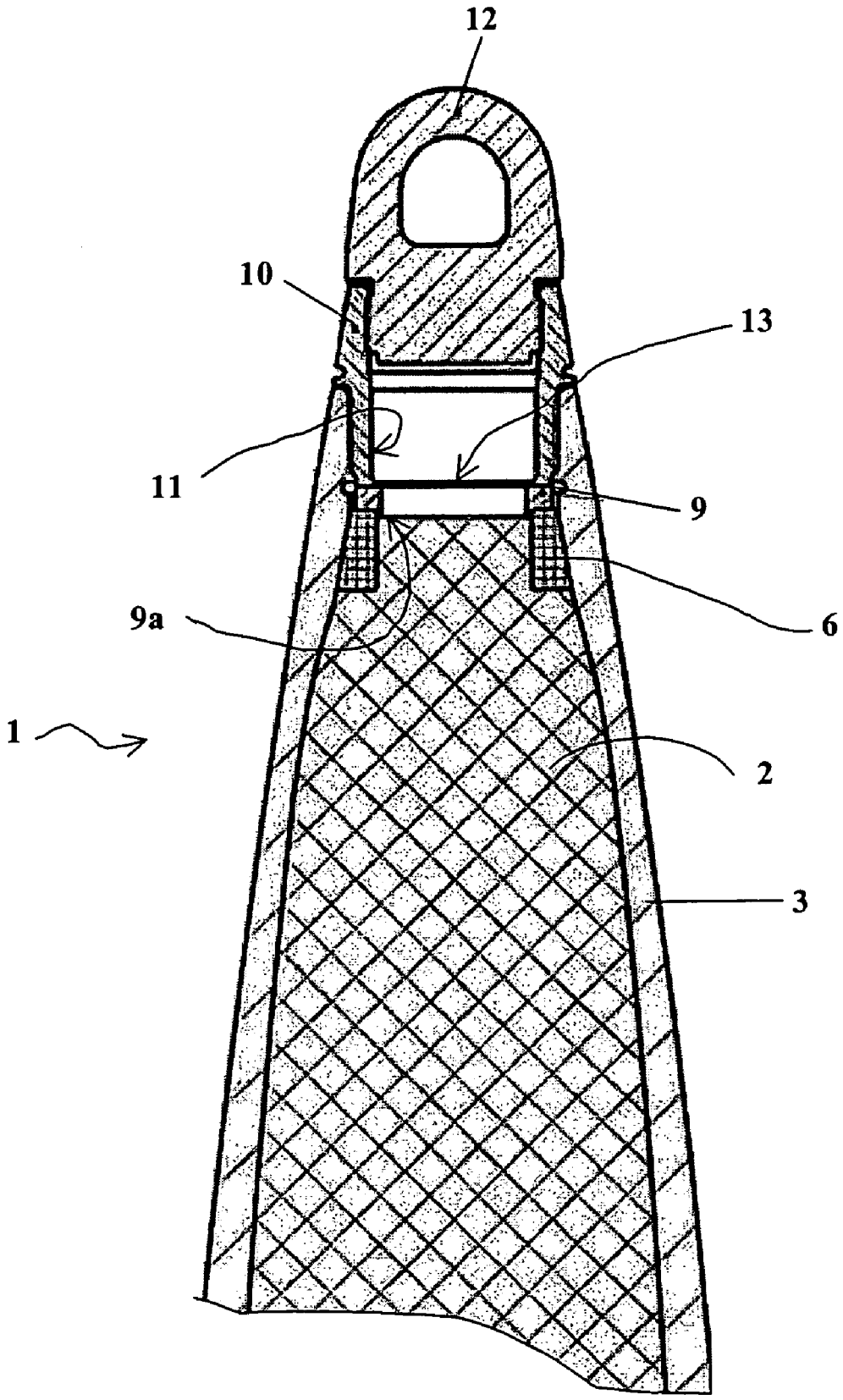
FIG. 3 shows this same shell after fastening a linking part intended to receive a fuse.

After the explosive load 2 has been solidified, a metallic washer 9 is positioned on the upper face of the ring 6 (see FIG. 3).

This washer 9 has an external diameter that is less than the internal diameter of the opening 4 and has an inner rim 9*a* that is positioned in the axial bore 6*b* in the ring.

It is thus unnecessary for the upper face of the explosive load to be machined after casting.

A linking part 10 is merely screwed into the opening 5 in the shell 1. When being screwed in place, this part presses on the washer 9 and pushes it so that it axially compresses the ring 6 by approximately 6 to 10 mm. The washer allows friction of the part 10. It thus allows the part 10 to be screwed in without any deterioration of the ring 6.

The linking part 10 and the washer 9 constitute compression means for the ring 6.

These means allow a compressive stress to be exerted constantly but reversibly on the shimming ring 6 over the full range of operational temperatures of the shell (from −46° C. to +63° C.). The ring 6 transmits this stress to the explosive load 2 which is thereby also held in place.

This enables the appearance of faults or cracks to be avoided, namely during rough handling at the lowest temperatures.

The linking part 10 incorporates an internal bore 11 enabling a fuse (not shown) to be fitted.

Here, the shell is shown in its storage configuration in which a transport ring 12 is screwed into the linking part 10 in place of the fuse.

The linking part 10 incorporates a bottom 13 enabling the explosive load 2 to be insulated from humidity. This bottom is broken when the fuse is ignited. It will incorporate a circular incipient fracture enabling part of the bottom to be projected onto the explosive load 2 thereby enabling its priming.

Such a linking part is the subject of patent application FR2781877 and will thus not be described here in further detail.

Figure 4:
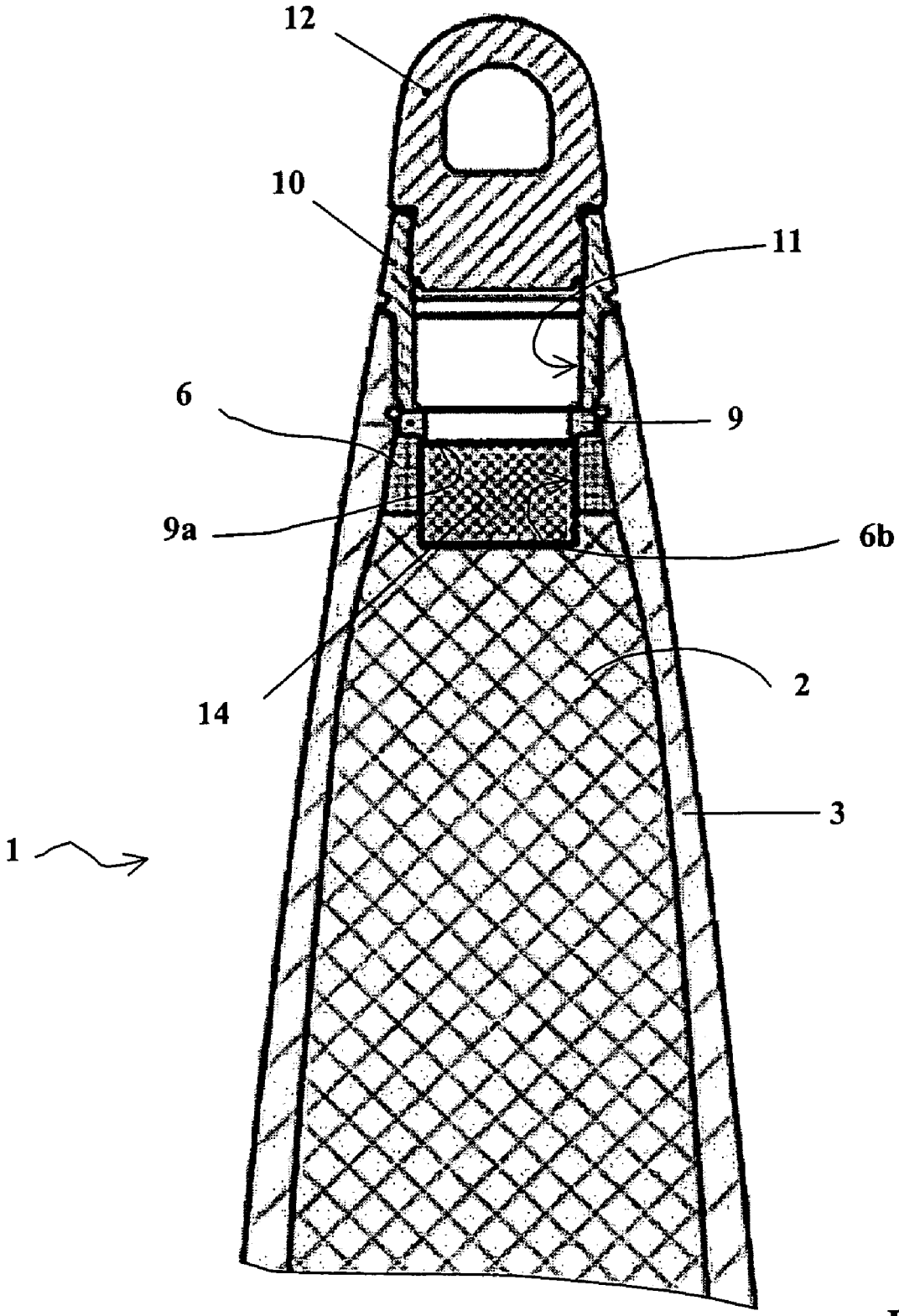
FIG. 4 is analogous to FIG. 3 but shows a shell according to another embodiment.

FIG. 4 shows another embodiment of a shell according to the invention.

This embodiment differs from the previous one in that a tablet of primer 14 is placed in the cylindrical axial bore 6*b* in the shimming ring 6. This tablet is intended to facilitate the priming of the explosive load 2 by the fuse (not shown). Such a tablet is classical and its composition (which depends on the nature of the explosive load) is not the subject of the present invention.

It is more particularly used when the explosive load has reduced sensitivity to attack (payload of a MURAT qualified shell as a MUnition with Risk ATtenuation).

These low sensitivity fusible payloads are described by patent FR2750131. They generally incorporate an insensitive explosive such as ONTA (oxynitrotriazol).

In known shells, the tablet of primer is bonded to the explosive load. However, the adhesive at the tablet/explosive interface causes poor transmission of the detonation. If the tablet is not bonded in place though, there is a risk of it moving during handling of the shell and being crumbled away.

In the shell according to the invention, the compression of the shimming ring 6 by screwing the linking part 10 causes a radial expansion of the ring 6 that in turn causes a reduction in the diameter of its bore 6*b*. In addition to shimming the explosive load 2, the ring 6 also holds the tablet of primer 14 firmly in contact with the explosive load 2.

Thus, thanks to the invention, it is no longer necessary for the tablet of primer 14 to be bonded in place. The reliability of the shell 1 is thereby improved.

With this embodiment of the invention, and so as to facilitate the ignition of the load 2 by the tablet 14; it is naturally necessary for the upper face of the explosive load to be machined after casting.

This embodiment also facilitates the demilitarization of the shells at the end of their useful life. The linking part 10 merely needs to be unscrewed.

The shimming ring 6 thereafter releases the tablet of primer 14 which may be easily removed. The explosive load 2 implemented by casting is fusible and it therefore easy to remove from the shell by heating.

What is claimed is:

1. An explosive shell comprising a fusible explosive load placed in a casing incorporating an opening, such shell comprising means for shimming the explosive load placed in the vicinity of said shell opening, such shimming means comprising a ring made of an elastic material placed between a front part of said casing and said explosive load, said ring being compressed by compression means, wherein said shimming ring incorporates a flange housed in a groove made in said casing of said shell and said shimming ring contacts said explosive load.

2. An explosive shell according to claim 1, wherein said compression means comprise a linking part screwed in said shell opening and exerting a compressive stress on said shimming ring.

3. An explosive shell according to claim 2, wherein said compression means comprise a washer placed between said linking part and said shimming ring.

4. An explosive shell according to claim 1, wherein said shimming ring has a cylindrical axial bore as well as an external profile matching the internal profile of said casing.

5. An explosive shell according to claim 1, wherein said shell comprises a tablet of primer placed in said cylindrical axial bore in the shimming ring.

6. An explosive shell according to claim 5, wherein said shimming ring is made of an elastomer material.

* * * * *